US010329864B2

(12) United States Patent
Nguyen

(10) Patent No.: US 10,329,864 B2
(45) Date of Patent: Jun. 25, 2019

(54) CONNECTOR ASSEMBLY FOR A MINERAL EXTRACTION SYSTEM

(71) Applicant: Cameron International Corporation, Houston, TX (US)

(72) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 216 days.

(21) Appl. No.: 15/392,071

(22) Filed: Dec. 28, 2016

(65) Prior Publication Data

US 2018/0179829 A1 Jun. 28, 2018

(51) Int. Cl.
*E21B 17/043* (2006.01)
*E21B 33/038* (2006.01)
*E21B 23/04* (2006.01)

(52) U.S. Cl.
CPC ..... *E21B 33/038* (2013.01); *E21B 17/043* (2013.01); *E21B 23/04* (2013.01)

(58) Field of Classification Search
CPC ..... E21B 17/043; E21B 33/038; E21B 33/04; E21B 23/04
See application file for complete search history.

(56) References Cited

U.S. PATENT DOCUMENTS 3,321,217 A 5/1967 Ahlstone
4,153,278 A * 5/1979 Ahlstone ..... F16L 27/06 285/146.3
4,496,172 A 1/1985 Walker
4,844,511 A 7/1989 Galle et al.
8,474,537 B2 * 7/2013 Voss ..... E21B 33/038 166/338
8,485,267 B2 * 7/2013 Nguyen ..... E21B 33/038 166/338
9,062,513 B2 * 6/2015 Pallini, Jr. ..... E21B 33/038
2013/0299186 A1 11/2013 Nguyen et al.
2016/0010404 A1 * 1/2016 Nguyen ..... E21B 19/10 166/77.51
2016/0281473 A1 9/2016 Delgado et al.

FOREIGN PATENT DOCUMENTS

WO 2009009085 A2 1/2009

OTHER PUBLICATIONS

PCT International Search Report & Written Opinion for PCT Application No. PCT/US2017/068312 dated Apr. 24, 2018; 14 Pages.

* cited by examiner

*Primary Examiner* — Michael R Wills, III
(74) *Attorney, Agent, or Firm* — Fletcher Yoder

(57) ABSTRACT

A connector assembly configured to join a first tubular member to a second tubular member of a mineral extraction system includes a first annular body, a second annular body, and at least one fastener extending through the first annular body and threadably coupled to the second annular body. A sealed space is defined between the at least one fastener and the first annular body. The connector assembly also includes a lock ring configured to contact the first annular body and the second annular body. A fluid pressure within the sealed space is configured to drive the first annular body and the second annular body toward one another, thereby driving the lock ring radially inwardly to engage the second tubular member.

20 Claims, 13 Drawing Sheets

CONNECTOR ASSEMBLY FOR A MINERAL EXTRACTION SYSTEM

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources, such as oil and gas, are used as fuel to power vehicles, heat homes, and generate electricity, in addition to a myriad of other uses. Once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various spools, housings, pipes, valves, fluid conduits, and the like, that facilitate drilling and/or extraction operations.

Certain components of the mineral extraction system, such as conduits, pipes, or other tubulars, may be joined and sealed by locking mechanisms to provide a flow path for fluids during extraction. However, because such locking mechanisms may utilize additional parts and tools (e.g., multiple threaded fasteners or bolts) to lock or unlock the components, the installation, repair, and/or replacement of such components may be tedious and inefficient.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
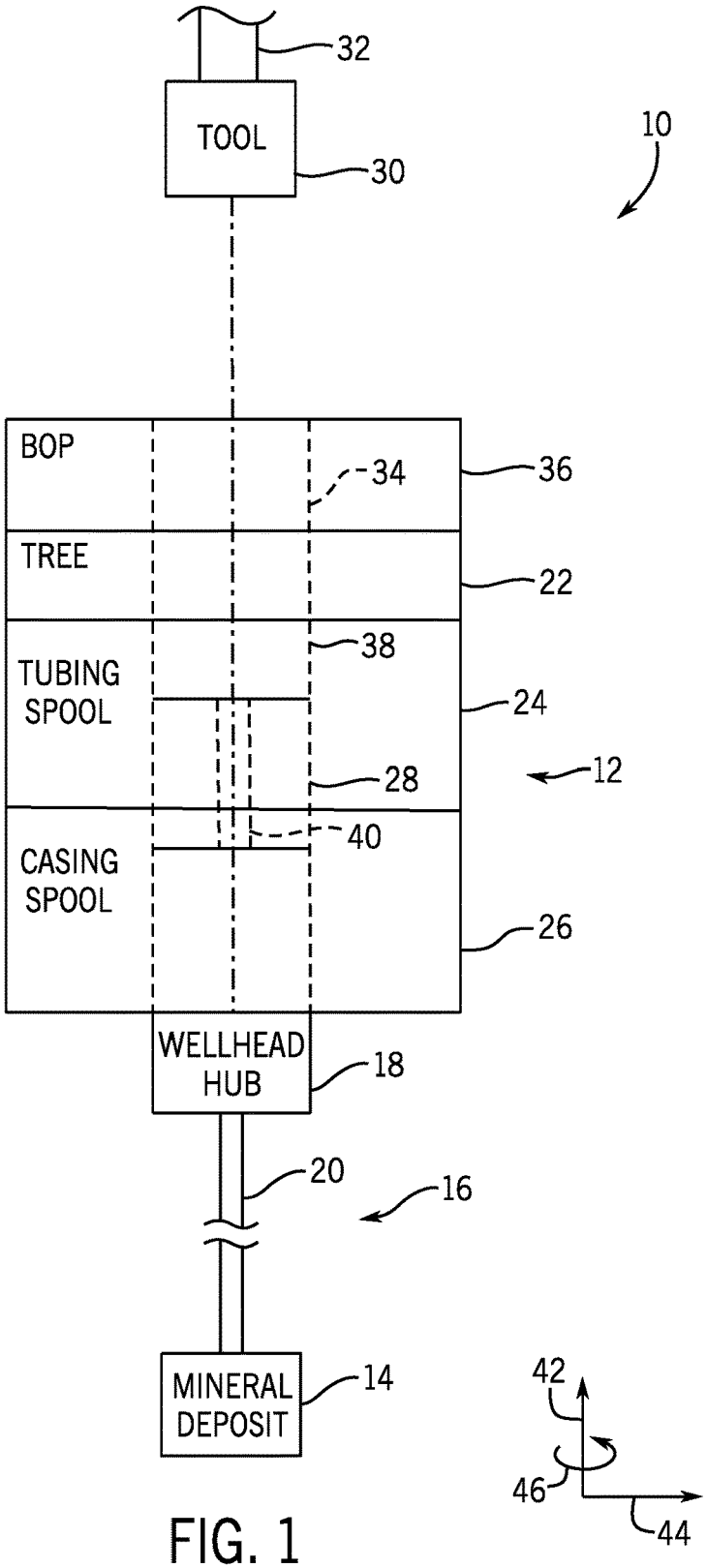
FIG. 1 block diagram of a mineral extraction system, in accordance with an embodiment of the present disclosure.

Embodiments of the present disclosure include systems and methods that utilize a connector assembly to connect components (e.g., tubular members) in a mineral extraction system. With the foregoing in mind, FIG. 1 is a block diagram of an embodiment of a mineral extraction system 10 that may utilize a connector assembly, as discussed in further detail below. The illustrated mineral extraction system 10 may be configured to extract various minerals and natural resources, including hydrocarbons (e.g., oil and/or natural gas), from the earth, or to inject substances into the earth. In some embodiments, the mineral extraction system 10 is land-based (e.g., a surface system) or sub-sea (e.g., a sub-sea system). As illustrated, the system 10 includes a wellhead 12 coupled to a mineral deposit 14 via a well 16. The well 16 may include a wellhead hub 18 and a well bore 20. The wellhead hub 18 generally includes a large diameter hub disposed at the termination of the well bore 20 and designed to connect the wellhead 12 to the well 16.

The wellhead 12 may include multiple components that control and regulate activities and conditions associated with the well 16. For example, the wellhead 12 generally includes conduits, valves, and seals that route produced minerals from the mineral deposit 14, regulate pressure in the well 16, and inject chemicals down-hole into the well bore 20. In the illustrated embodiment, the wellhead 12 includes what is colloquially referred to as a Christmas tree 22 (hereinafter, a tree), a tubing spool 24, a casing spool 26, and a hanger 28 (e.g., a tubing hanger and/or a casing hanger). The system 10 may include other components that are coupled to the wellhead 12, and devices that are used to assemble and control various components of the wellhead 12. For example, in the illustrated embodiment, the system 10 includes a running tool 30 suspended from a drill string 32. In certain embodiments, the running tool 30 includes a running tool that is lowered (e.g., run) from an offshore vessel to the well 16 and/or the wellhead 12. In other embodiments, such as surface systems, the running tool 30 may be suspended over and/or lowered into the wellhead 12 via a crane or other supporting device.

The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the tree 22 includes a tree bore 34. The tree bore 34 provides for completion and workover procedures, such as the insertion of tools into the well 16, the injection of various chemicals into the well 16, and so forth. Further, minerals extracted from the well 16 (e.g., oil and natural gas) may be regulated and routed via the tree 22. For instance, the tree 22 may be coupled to a jumper or a flowline that is tied back to other components, such as a manifold. Accordingly, produced minerals flow from the well 16 to the manifold via the wellhead 12 and/or the tree 22 before being routed to shipping or storage facilities. A blowout preventer (BOP) 36 may also be included, either as a part of the tree 22 or as a separate structure. The BOP 36 may consist of a variety of valves, fittings, and controls to prevent oil, gas, or other fluid from exiting the well in the event of an unintentional release of pressure or an overpressure condition during drilling operations, for example.

The tubing spool 24 provides a base for the tree 22. The tubing spool 24 is one of many components in a modular sub-sea or surface mineral extraction system 10 that is run from an offshore vessel or surface system. The tubing spool 24 includes a tubing spool bore 38. The tubing spool bore 38 connects (e.g., enables fluid communication between) the tree bore 34 and the well 16. Thus, the tubing spool bore 38 may provide access to the well bore 20 for various completion and workover procedures. For example, components can be run down to the wellhead 12 and disposed in the tubing spool bore 38 to seal off the well bore 20, to inject chemicals down-hole, to suspend tools down-hole, to retrieve tools down-hole, and so forth.

The well bore 20 may contain elevated pressures. For example, the well bore 20 may include pressures that exceed 10,000, 15,000, or even 20,000 pounds per square inch (psi). Accordingly, the mineral extraction system 10 may employ various mechanisms, such as seals, plugs, and valves, to control and regulate the well 16. For example, plugs and valves are employed to regulate the flow and pressures of fluids in various bores and channels throughout the mineral extraction system 10. For instance, the illustrated hanger 28 (e.g., tubing hanger or casing hanger) may be disposed within the wellhead 12 to secure casing suspended in the well bore 20, and to provide a path for hydraulic control fluid, chemical injections, and so forth. The hanger 28 includes a hanger bore 40 that extends through the center of the hanger 28, and that is in fluid communication with the tubing spool bore 38 and the well bore 20. One or more seal assemblies and/or landing assemblies may be disposed between the hanger 28 and the tubing spool 24 and/or the casing spool 26. As shown, the wellhead 12 include various tubular members (e.g., a tubular member of the wellhead hub 18, the casing spool 26, the tubing spool 24, the tree 22, the BOP 36, or various spools, housings, adapters, or pipes that define respective bores or fluid flow paths), and the various tubular members may be joined to one another to facilitate drilling and extraction operations.

One or more connector assemblies (e.g., tubular connector assemblies) may also be utilized to join components of the mineral extraction system 10 to one another. For example, a connector assembly may be utilized to join a first component to a second component (e.g., a first tubular to a second tubular, such as the wellhead hub 18 to the casing spool 26, the casing spool 26 to the tubing spool 24, the tubing spool 24 to the tree 22, the tree 22 to the BOP 36, portions of the tree 22 to one another, or to join any of a variety of other components, such as spools, housings, adapters, or pipes to one another or to the wellhead hub 18, the casing spool 26, the tubing spool 24, the tree 22, the BOP 36) within the mineral extraction system 10. The disclosed connector assemblies may effectively and efficiently join components to one another, thereby increasing operational efficiency, for example. To facilitate discussion, the components of the mineral extraction system 10, including the connector assemblies, may be described with reference to an axial axis or direction 42, a radial axis or direction 44, and a circumferential axis or direction 46.

Figure 2:
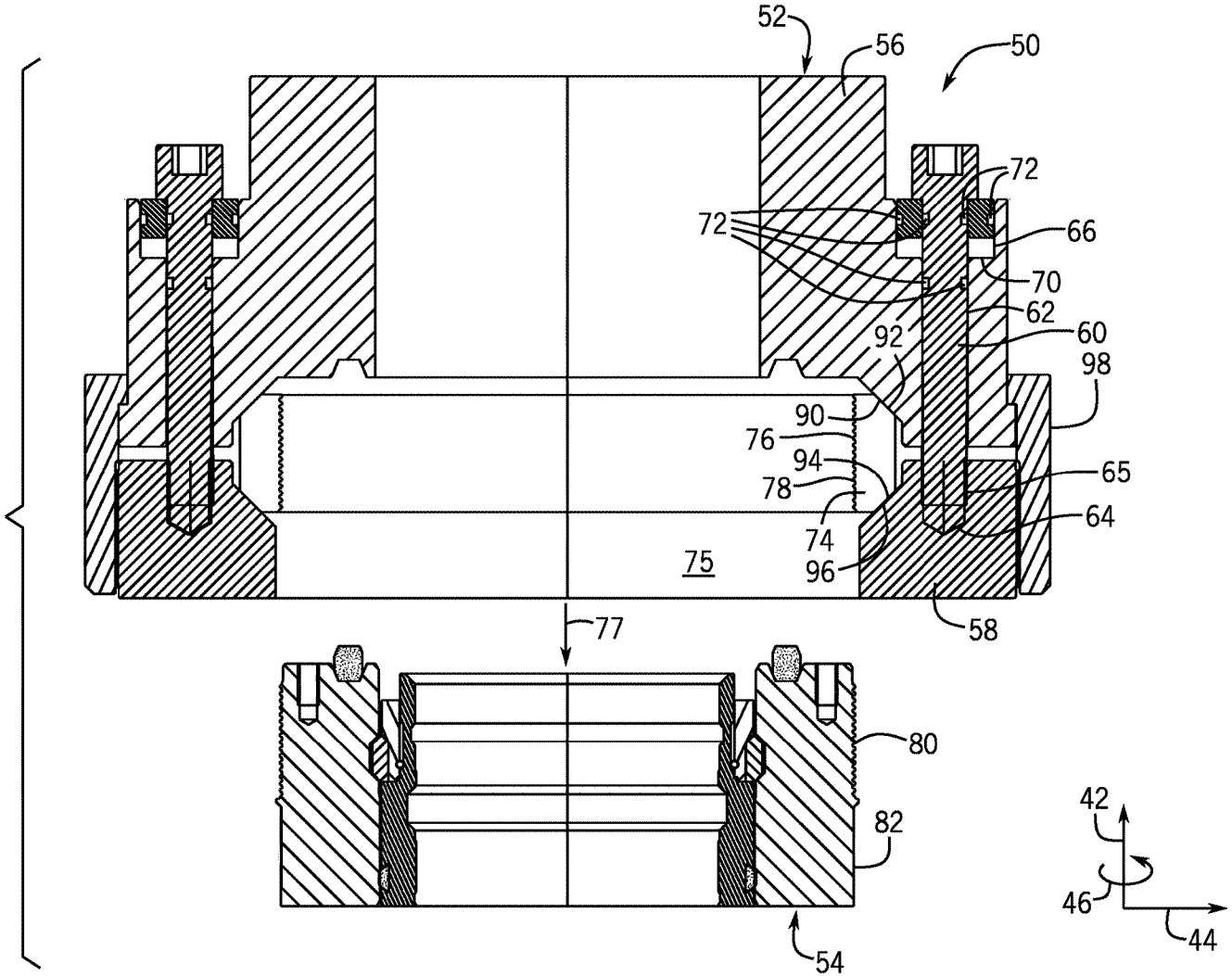
FIG. 2 is a cross-sectional side view of an embodiment of a connector assembly having a lock ring with multiple grooves that may be utilized to join a first component to a second component of the mineral extraction system of FIG. 1.

FIG. 2 is a cross-sectional side view of an embodiment of a connector assembly 50 that may be utilized to join a first component 52 (e.g., a first tubular component) to a second component 54 (e.g., a second tubular component) within the mineral extraction system 10 of FIG. 1. As noted above, the first component 52 and the second component 54 may be any of a variety of structures, including wellhead hub 18, the casing spool 26, the tubing spool 24, the tree 22, the BOP 36, or any of a variety of other components, such as spools, housings, adapters, or pipes that may be utilized with the wellhead 12 or other portions of the mineral extraction system 10.

In the illustrated embodiment, the first component 52 supports the connector assembly 50, which includes a first body 56 (e.g., annular body) and a second body 58 (e.g., annular body). In some embodiments, the first body 56 or the second body 58 may be an adapter coupled to the first component 52 (e.g., via one or more fasteners, such as bolts). In some embodiments, the first body 56 and/or the second body 58 may be or form part of a main body (e.g., tubular section or pipe) of the first component 52. For example, in FIG. 1, the first body 56 is part of a main body of the first component 52, and the first body 56 contacts fluid that flows through the second component 54. As shown, multiple fasteners 60 extend axially through corresponding openings 62 formed in the first body 56 and into corresponding openings 64 (e.g., threaded openings) formed in the second body 58. Thus, each fastener 60 is coupled (e.g., threadably coupled) to the second body 58 via a respective threaded interface 65.

A respective groove 66 is formed in the first body 56 of the first component 52 at the location of each fastener 60, and each fastener 60 extends through a seal 68 (e.g., annular seal). The seal 68 is positioned within the groove 66 to form a sealed space 70 (e.g., annular space or hydraulic chamber). As shown, additional seals 72 (e.g., o-ring seals or annular seals) are positioned at various locations to block fluid flow and to seal the sealed space 70. The multiple fasteners 60 (e.g., 2, 3, 4, 5, 6, 7, 8, 9, 10, or more) and associated features (e.g., the seals 68, the grooves 66, etc.) may be positioned circumferentially about the connector assembly 50.

The connector assembly 50 may move between a first position (e.g., unlocked position) and second position (e.g., unlocked position). In the first position, a lock ring 74 (e.g., segmented ring or c-shaped ring) is in an expanded position (e.g., radially-expanded position) in which the lock ring 74 does not protrude radially into a bore 75 (e.g., central bore) and/or enables the lock ring 74 to receive the second component 54 (e.g., the connector assembly 50 can be moved axially, as shown by arrow 77, to a position in which the lock ring 74 circumferentially surrounds the second component 54). As shown, the lock ring 74 includes a first tapered surface 90 (e.g., circumferentially-extending surface) in contact with a corresponding tapered surface 92 (e.g., tapered annular surface, conical surface, camming surface, energizing surface) of the first body 56 of the first component 52 and a second tapered surface 94 (e.g., circumferentially-extending surface) in contact with a corresponding tapered surface 96 (e.g., tapered annular surface, conical surface, camming surface, energizing surface) of the second body 58.

In certain embodiments, the lock ring 74 may be a segmented ring or c-shaped ring having a first circumferential end and a second circumferential end that define a space (e.g., a gap) at a circumferential location about the ring. Such a configuration enables radial adjustment of the lock ring 74, as discussed in more detail below. As shown, a radially-inner surface 76 (e.g., annular surface) of the lock ring 74 includes multiple grooves or teeth 78 that are configured to engage corresponding grooves 80 formed in a radially-outer surface 80 (e.g., annular surface) of the second component 54. However, it should be understood that the radially-inner surface 76 and the radially-outer surface 80 may have any of a variety of corresponding surfaces or features that facilitate coupling the lock ring 74 to the second component 54 (e.g., blocking relative axial movement).

In operation, the first component 52 supporting the connector assembly 50 and/or the second component 54 may be moved relative to one another to position the second component 54 within the lock ring 74 of the connector assembly 50. For example, the second component 54 may be in a fixed position over a well, and the connector assembly 50 may be lowered axially, as shown by arrow 77, until the multiple teeth and grooves 78 of the lock ring 74 are axially aligned with the corresponding teeth and grooves 80 of the second component 54. As discussed in more detail below, fluid (e.g., hydraulic fluid, liquid, or gas) may then be provided to the sealed space 70 to drive the first body 56 of the first component 52 axially relative to the second body 58. The axial movement of the first body 56 of the first component 52 drives the lock ring 74 radially-inwardly (e.g., via a wedging action due to contact between the tapered surfaces 90, 92, 94, 96) to engage the teeth and grooves 78 with the corresponding teeth and grooves 80 of the second component 54, thereby locking the first component 52 to the second component 54 (e.g., blocking axial movement of the first component 52 relative to the second component 54). As discussed in more detail below, the connector assembly 50 includes an outer sleeve 98 (e.g., annular sleeve) which may be utilized to hold the first component 52 and the second component 54 together.

Figure 3:
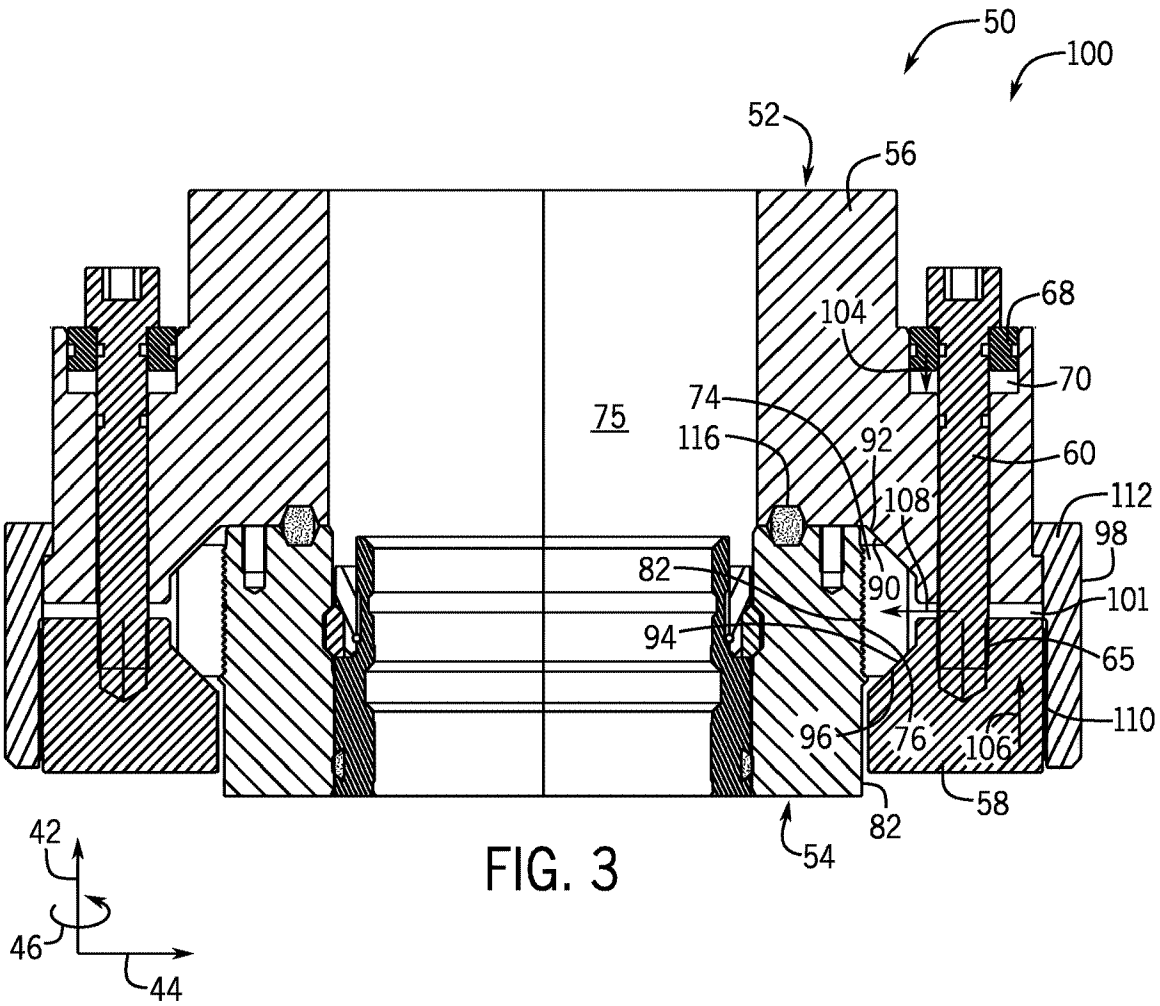
FIG. 3 is a cross-sectional side view of the connector assembly of FIG. 2, wherein the connector assembly is in a locked position that joins the first component to the second component.

FIG. 3 is a cross-sectional side view of the connector assembly 50 of FIG. 2. In FIG. 3, the connector assembly 50 is in a second position 100 (e.g., locked position). In the second position 100, the lock ring 74 is in a contracted position (e.g., radially-contracted position) in which the lock ring 74 contacts the second component 54, engages the second component 54, and/or blocks axial movement of the second component 54 relative to the lock ring 74 and the first component 52, for example.

Figure 4:
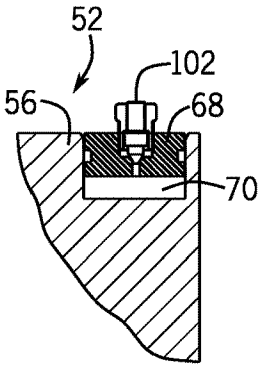
FIG. 4 is a cross-sectional side view of an embodiment of a port that may be utilized in the connector assembly of FIGS. 2 and 3.

To achieve the second position 100, fluid may be provided to the sealed space 70, such as via one or more ports 102, as shown in FIG. 4. As shown in FIG. 4, the one or more ports 102 are supported by the seal 68 and are configured to provide fluid to the sealed space 70. The one or more ports 102 may be positioned between adjacent fasteners 60 about the circumference of the first body 56 of the first component 52. In some embodiments, multiple ports 102 (e.g., 2, 3, 4, 5, 6, or more) may be positioned about the circumference in any suitable location. It should be understood that the ports 102 may be positioned at any suitable location of the connector assembly 50 and that the fluid may be provided to the sealed space 70 via any suitable technique.

When the fluid is provided to the sealed space 70 (e.g., via the one or more ports 102), the fluid may cause the first body 56 of the first component 52 and the second body 58 to move toward one another, thereby reducing a space 101 (e.g., annular space) between the first body 56 of the first component 52 and the second body 58 along the axial axis 44. In particular, when fluid is provided to the sealed space 70, the fluid may drive the first body 56 of the first component 52 axially, as shown by arrow 104, and/or the fluid may drive the second body 58 axially, as shown by arrow 106 (e.g., because the fastener 60 is threadably coupled to the second body 58 via the threaded interface 65). Therefore, when the fluid is provided to the sealed space 70 and as an axial distance across the space 101 is reduced, the first body 56 of the first component 52 and the second body 58 drive the lock ring 74 radially-inwardly, as shown by arrow 108, to engage the second component 54.

In particular, contact between the tapered surface 90 and the corresponding tapered surface 92 of the first body 56 of the first component 52 and contact between the tapered surface 94 and the corresponding tapered surface 96 of the second component 54 as the fluid is provided to the sealed space 70 drives the lock ring 74 radially-inwardly until the multiple grooves 76 of the lock ring 76 engage the corresponding grooves 80 of the second component 54, thereby locking the first component 52 to the second component 54 (e.g., blocking axial movement of the first component 52 relative to the second component 54).

While the fluid is within the sealed space 70 and the lock ring 74 engages the second component 54, the outer sleeve 98 may be positioned about the first component 52 and the second component 54, and then rotated to threadably couple the outer sleeve 98 to the second component 54 via a threaded interface 110. The outer sleeve 98 may be rotated and move axially relative to the first component 52 and the second component 54 until a lip 112 (e.g., radially-inwardly expanding portion) of the outer sleeve 98 contacts and engages a corresponding portion 114 (e.g., radially-outwardly expanding portion) of the first body 56 of the first component 52. Once the outer sleeve 98 is in place about the first component 52 and component 54, the outer sleeve 98 may maintain the connector assembly 50 in the locked position 100, thereby locking the first component 52 to the second component 54. In some embodiments, the fluid pressure within the sealed space 70 may be reduced or removed, and the outer sleeve 98 may maintain the locked position 100. As shown, one or more seals 116 (e.g., o-rings or annular seals) may be positioned between the first component 52 and the second component 56 to block fluid flow from the bore 75, for example.

Figure 5:
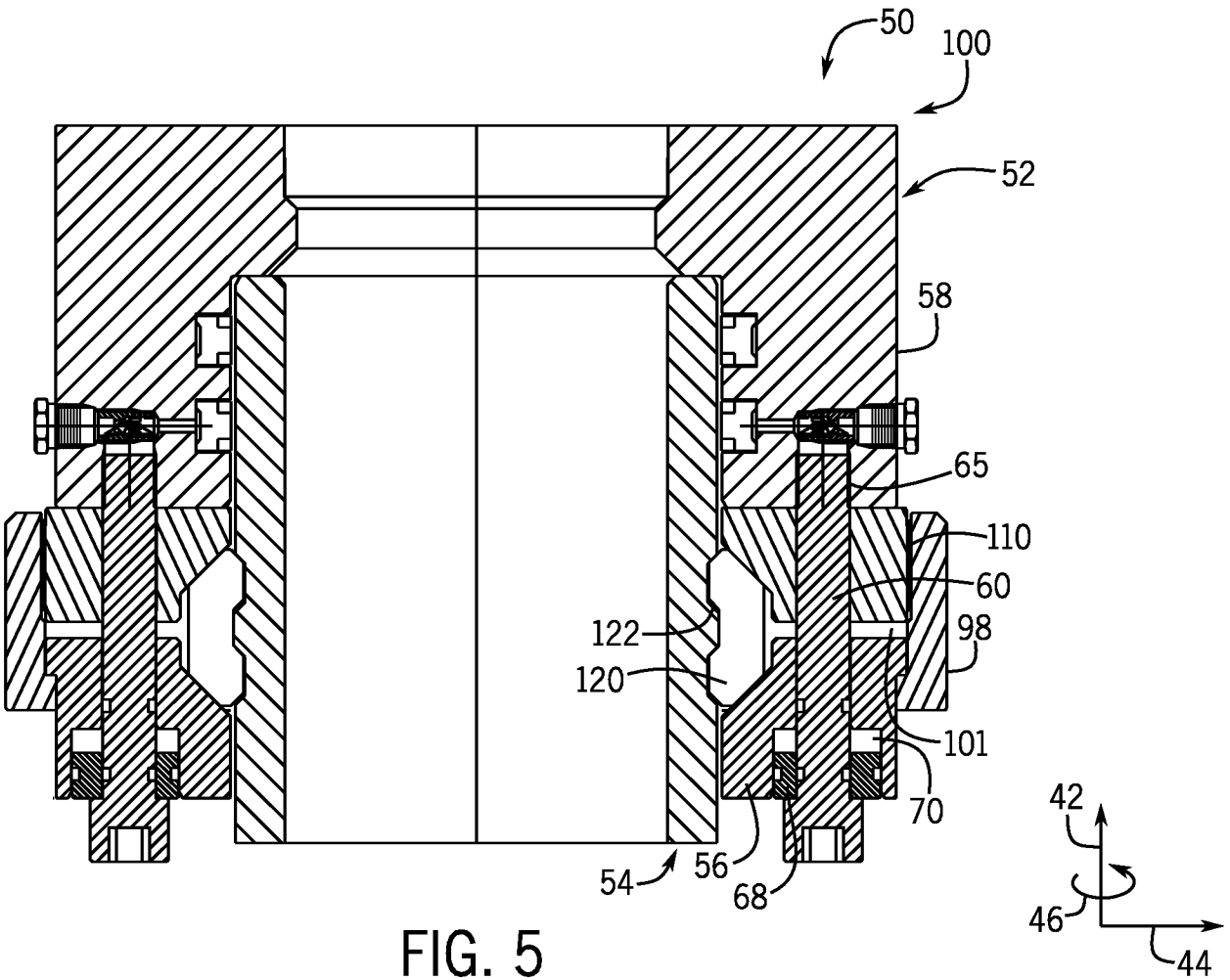
FIG. 5 is a cross-sectional side view of an embodiment of a connector assembly having a lock ring with a c-shaped profile that may be utilized to join a first component to a second component of the mineral extraction system of FIG. 1.

FIG. 5 is a cross-sectional side view of an embodiment of the connector assembly 50 having a lock ring 120 (e.g., segmented ring or c-shaped ring) with a c-shaped profile (e.g., cross-section taken in a plane parallel to the axial axis 44) that may be utilized to join the first component 52 to the second component 54. As noted above, the first body 56 and/or the second body 58 may be or form part of a main body (e.g., tubular section or pipe) of the first component 52. In FIG. 5, the second body 58 is part of a main body of the first component 52, and the second body 58 contacts fluid that flows through the second component 54. In the illustrated embodiment, the threaded fastener 60 extends axially through the first body 56 and is threadably coupled to the second body 58 via the threaded interface 65. As fluid is provided to the sealed space 70 (e.g., via ports, such as the ports shown in FIG. 4), the first body 56 and the second body 58 may move toward one another, thereby reducing the axial distance across the space 101 and driving the lock ring 120 radially inwardly to engage a corresponding recess 122 (e.g., annular recess) in the second component 54. The outer sleeve 98 may be threadably coupled to the second body 58, thereby maintaining the illustrated locked position 100. As discussed above, the first component 52 and the second component 54 may be any of a variety of tubular members or other components within the mineral extraction system 10, and thus, may support or include various ports, seals, hangers, or the like, as shown in FIGS. 2, 3, and 5, for example.

Figure 6:
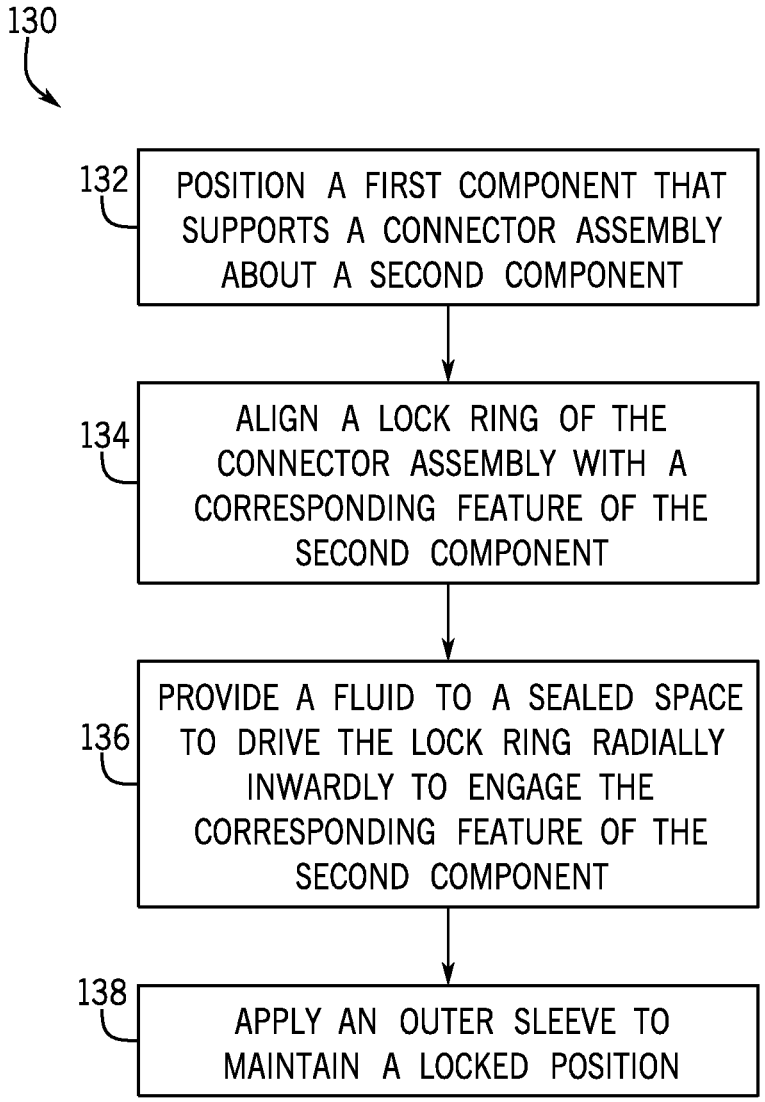
FIG. 6 is a flow diagram of an embodiment of a method for joining two components of a mineral extraction system to one another using the connector assembly of FIGS. 1-5.

FIG. 6 is a flow diagram of an embodiment of a method 130 for joining two components (e.g., the first component 52 and the second component 54) of the mineral extraction system 10 to one another using the connector assembly 50 illustrated in FIGS. 2-5. The method 130 includes various steps represented by blocks. It should be noted that some or all of the steps of the method 130 may be performed as an automated procedure by an automated system and/or some or all of the steps of the method 130 may be performed manually by an operator. Although the flow chart illustrates the steps in a certain sequence, it should be understood that the steps may be performed in any suitable order and certain steps may be carried out simultaneously, where appropriate. Further, certain steps or portions of the method 130 may be omitted and other steps may be added.

The method 130 may begin by positioning the first component 52 that supports the connector assembly 50 about the second component 54, as shown in step 132. For example, the first component 52 may be moved relative to the second component 54 until the lock ring 74, 120 is axially aligned with a corresponding feature (e.g., grooves 80, recess 122) of the second component 54, as shown in step 134. A fluid may then be provided to the sealed space 70, which causes portions of the connector assembly 50 (e.g., the first body 56 and the second body 58) to move toward one another, which in turn drives the lock ring 74, 120 radially-inwardly (e.g., via a wedging or camming action due to contact between surface 90, 92, 94, 96) to engage the corresponding feature of the second component 54, as shown in step 136. The outer sleeve 98 may be applied about the first body 56 and the second body 56 to maintain the locked position 100 (e.g., the outer sleeve 98 may be coupled to the second body 58 via the threaded interface 110 and the lip 112 of the outer sleeve 98 may engage the first body 56, thereby maintaining the locked position 100).

Figure 7:
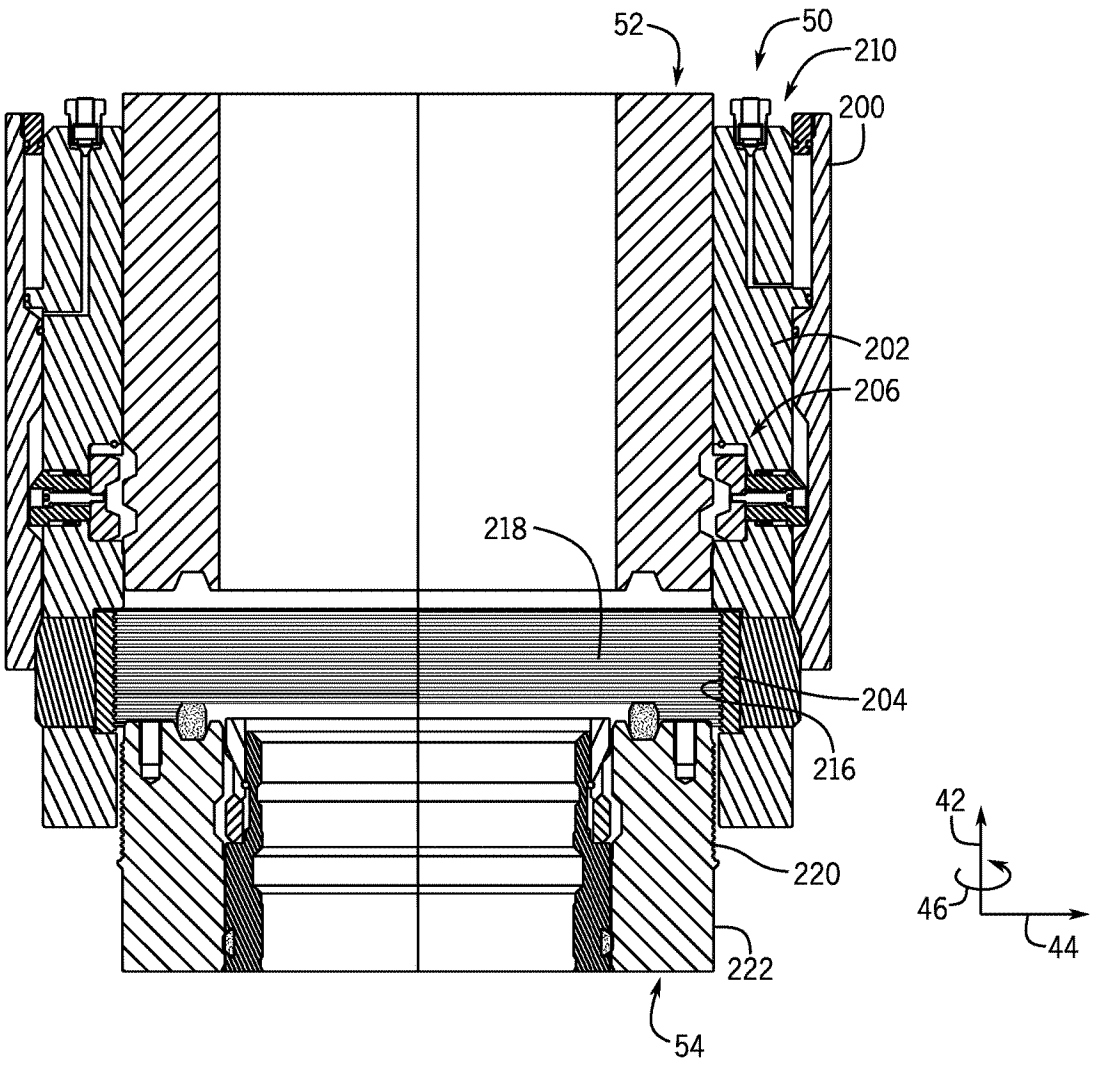
FIG. 7 is a cross-sectional side view of an embodiment of a connector assembly having a sliding outer sleeve that may be utilized to join a first component to a second component of the mineral extraction system of FIG. 1.

FIG. 7 is a cross-sectional side view of an embodiment of a connector assembly 50 having a sliding outer sleeve 200 (e.g., annular sleeve) that may be utilized to join the first component 52 to the second component 54 of the mineral extraction system 10. As noted above, the first component 52 and the second component 54 may be any of a variety of structures, including the wellhead hub 18, the casing spool 26, the tubing spool 24, the tree 22, the BOP 36, or any of a variety of other components, such as spools, housings, adapters, or pipes that may be utilized with the wellhead 12 or other portions of the mineral extraction system 10.

As shown, the connector assembly 50 includes the sliding outer sleeve 200 and a body 202 (e.g., annular body). In the illustrated embodiment, the body 202 contacts and circumferentially surrounds the first component 52, and the sliding outer sleeve 200 contacts and circumferentially surrounds the body 202. The body 202 supports a lock ring 204 (e.g., segmented ring or c-shaped ring) and one or more locking dog assemblies 206. In FIG. 7, the connector assembly 50 is in a first position 210 (e.g., unlocked position). In the first position 210, the lock ring 204 and/or the locking dog assemblies 206 are in an expanded position (e.g., radially-expanded position) in which the lock ring 204 and/or the locking dog assemblies 206 do not protrude radially inwardly beyond a radially-inner surface 212 of the body 202, enable the body 202 may move relative to the first component 52, and/or enable the lock ring 204 to receive the second component 54 (e.g., the connector assembly 50 can be moved axially to a position in which the lock ring 204 circumferentially surrounds the second component 54).

Figure 8:
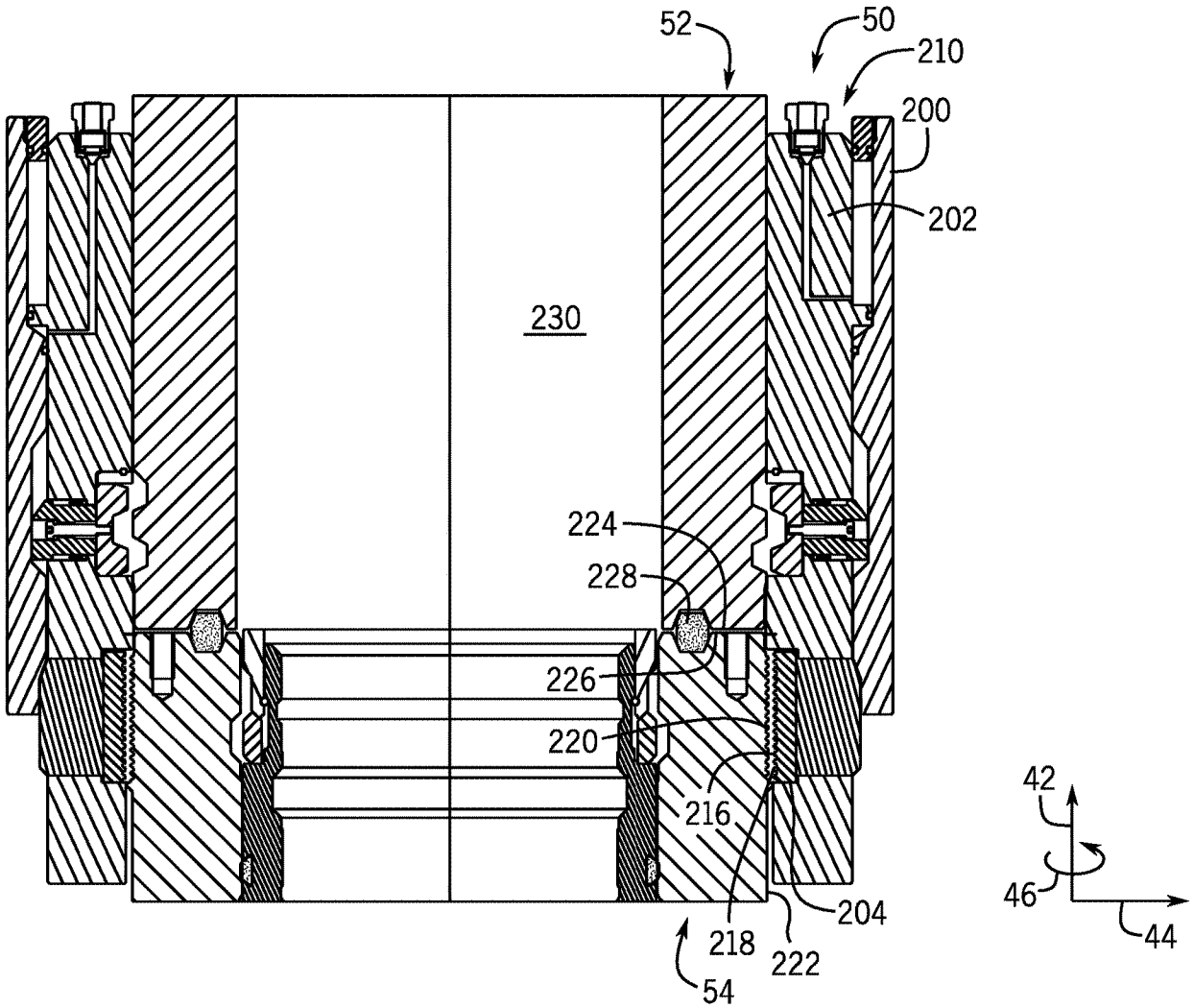
FIG. 8 is a cross-sectional side view of the connector assembly of FIG. 7, wherein a lock ring of the connector assembly is aligned with a corresponding portion of the second component.

In certain embodiments, the lock ring 204 may be a segmented ring or c-shaped ring having a first circumferential end and a second circumferential end that define a space (e.g., a gap) at a circumferential location about the ring. Such a configuration enables radial adjustment of the lock ring 204, as discussed in more detail below. As shown, a radially-inner surface 216 (e.g., annular surface) of the lock ring 204 includes multiple grooves or teeth 218 that are configured to engage corresponding teeth and grooves 220 formed in a radially-outer surface 222 (e.g., annular surface) of the second component 54. However, it should be understood that the radially-inner surface 216 and the radially-outer surface 222 may have any of a variety of corresponding surfaces or features that facilitate coupling the lock ring 204 to the second component 54 (e.g., blocking relative axial movement). FIG. 8 is a cross-sectional side view of the connector assembly 50 of FIG. 7 with the lock ring 204 aligned with the corresponding teeth and grooves 220 of the second component 54. When the corresponding teeth and grooves 218 of the lock ring 204 and the corresponding teeth and grooves 220 of the second component 54 are aligned, a contacting surface 224 (e.g., annular surface, axially-facing surface) of the first component 52 may contact a contacting surface 226 (e.g., annular surface, axially-facing surface) of the second component 54, as shown. A seal 228 (e.g., o-ring or annular seal) may be positioned between the surfaces 224, 226 to block fluid flow from a bore 230 (e.g., central bore or fluid flow path) defined by the first component 52 and the second component 54.

Figure 9:
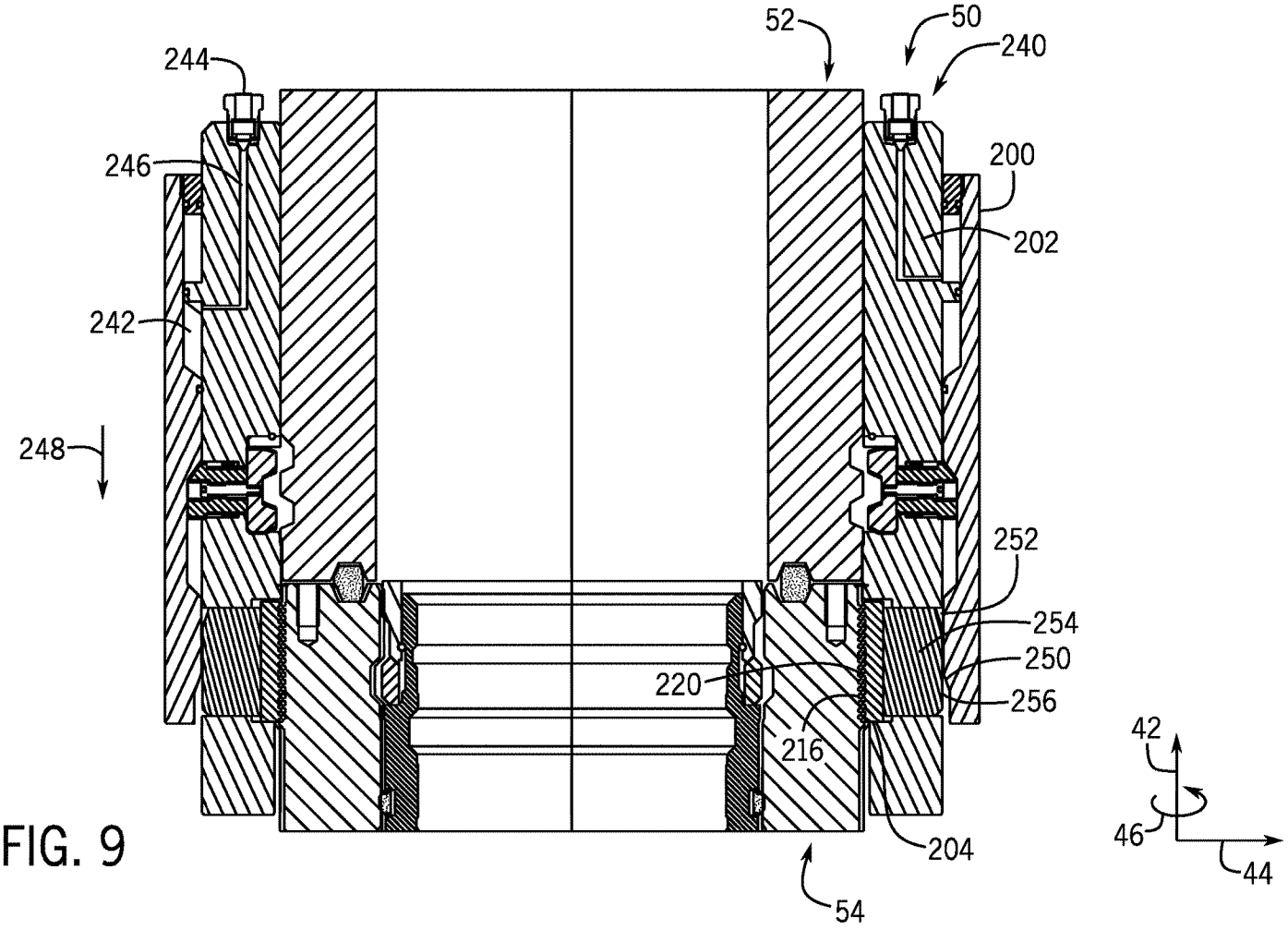
FIG. 9 is a cross-sectional side view of the connector assembly of FIGS. 7 and 8, wherein the lock ring of the connector assembly engages the corresponding portion of the second component.

FIG. 9 is a cross-sectional side view of the connector assembly 50 of FIGS. 7 and 8, wherein the connector assembly 50 is in a second position 240 (e.g., locked position). In the second position 240, the lock ring 204 is in a contracted position (e.g., radially-contracted position) in which the lock ring 204 contacts the second component 54, engages the second component 54, and/or blocks axial movement of the second component 54 relative to the lock ring 204 and/or the first component 52, for example.

To achieve the second position 240, a fluid (e.g., hydraulic fluid, liquid, or gas) may be provided to a sealed space 242 (e.g., annular space) defined between the sliding outer sleeve 200 and the body 202 along the radial axis 44. The fluid may be provided via one or more ports 244 and corresponding passageways 246 extending through the body 202 of the connector assembly 50, for example. When the fluid is provided to the sealed space 242, the fluid pressure drives the sliding outer sleeve 200 axially, as shown by arrow 248. As the sliding outer sleeve 200 moves relative to the body 202, a tapered inner surface 250 (e.g., tapered annular surface or conical surface) of the sliding outer sleeve 200 moves along a corresponding tapered outer surface 252 (e.g., tapered annular surface or conical surface) of a push ring 254 (e.g., annular push ring) until a contacting surface 256 (e.g., radially-inner surface, annular surface) of the sliding outer sleeve 200 is positioned circumferentially about the push ring 254, thereby driving the push ring 254 and the lock ring 204 radially inwardly to engage the corresponding grooves 220 of the second component 54.

Figure 10:
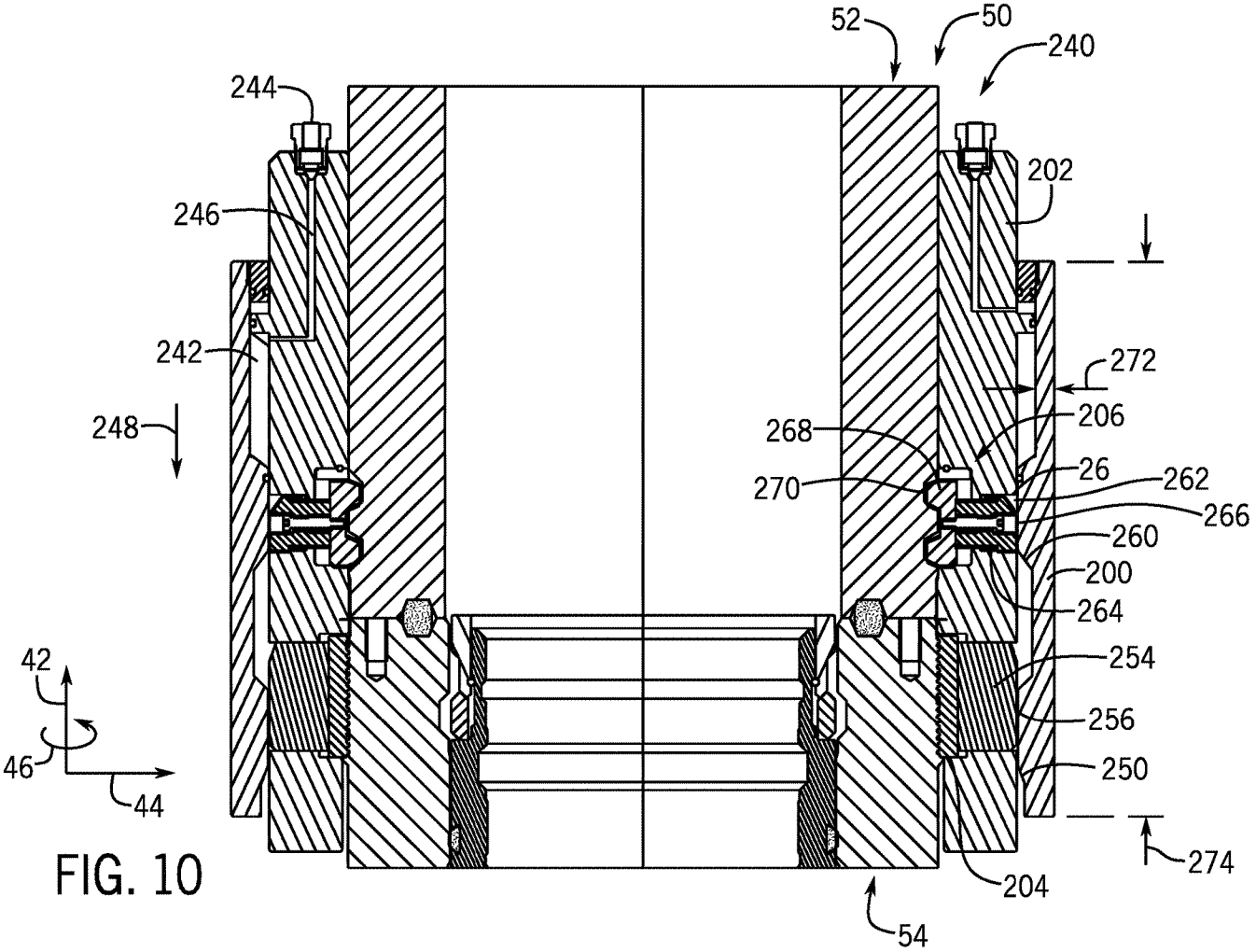
FIG. 10 is a cross-sectional side view of the connector assembly of FIGS. 7-9, wherein dogs of the connector assembly engage the first component.

FIG. 10 is a cross-sectional side view of the connector assembly 50 of FIGS. 7-9, wherein the locking dog assemblies 206 of the connector assembly 50 engage the first component 52. In operation, once the lock ring 204 engages the second component 54, additional fluid may be provided to the sealed space 242 (e.g., via the one or more ports 244 and corresponding passageways 246), and the fluid pressure drives the sliding outer sleeve 200 axially, as shown by arrow 248. As the sliding outer sleeve 200 moves relative to the body 202, a tapered inner surface 260 (e.g., tapered annular surface or conical surface) of the sliding outer sleeve 200 moves along a corresponding tapered outer surface 262 (e.g., tapered annular surface or conical surface) of a push ring 264 (e.g., annular push ring) until a contacting surface 266 (e.g., radially-inner surface, annular surface) of the sliding outer sleeve 200 is positioned circumferentially about the push ring 264, thereby driving the push ring 264 and a dog 268 (e.g., protrusion, key, bump, or the like) radially inwardly to engage a corresponding feature 270 (e.g., groove) of the first component 52. As shown, a width 272 (e.g., along the radial axis 44) varies along a length 274 of the sliding outer sleeve 200. This variation in width 272 enables the sliding outer sleeve 200 to include and/or support various features, such as the tapered outer surfaces 252, 260, the sealed space 242, and contacting surfaces 256, 266 that drive and hold both push rings 254, 264 radially inwardly, for example. Furthermore, in some embodiments, the geometry of the contacting surfaces 256, 266 and/or the interface between the contacting surfaces 256, 266 and the push rings 254, 264 (e.g., straight cylindrical contacting surfaces, axially-extending surfaces) may enable the sliding outer sleeve 200 to maintain the locked position 240 even after fluid pressure within the sealed space 242 is reduce or removed.

Figure 11:
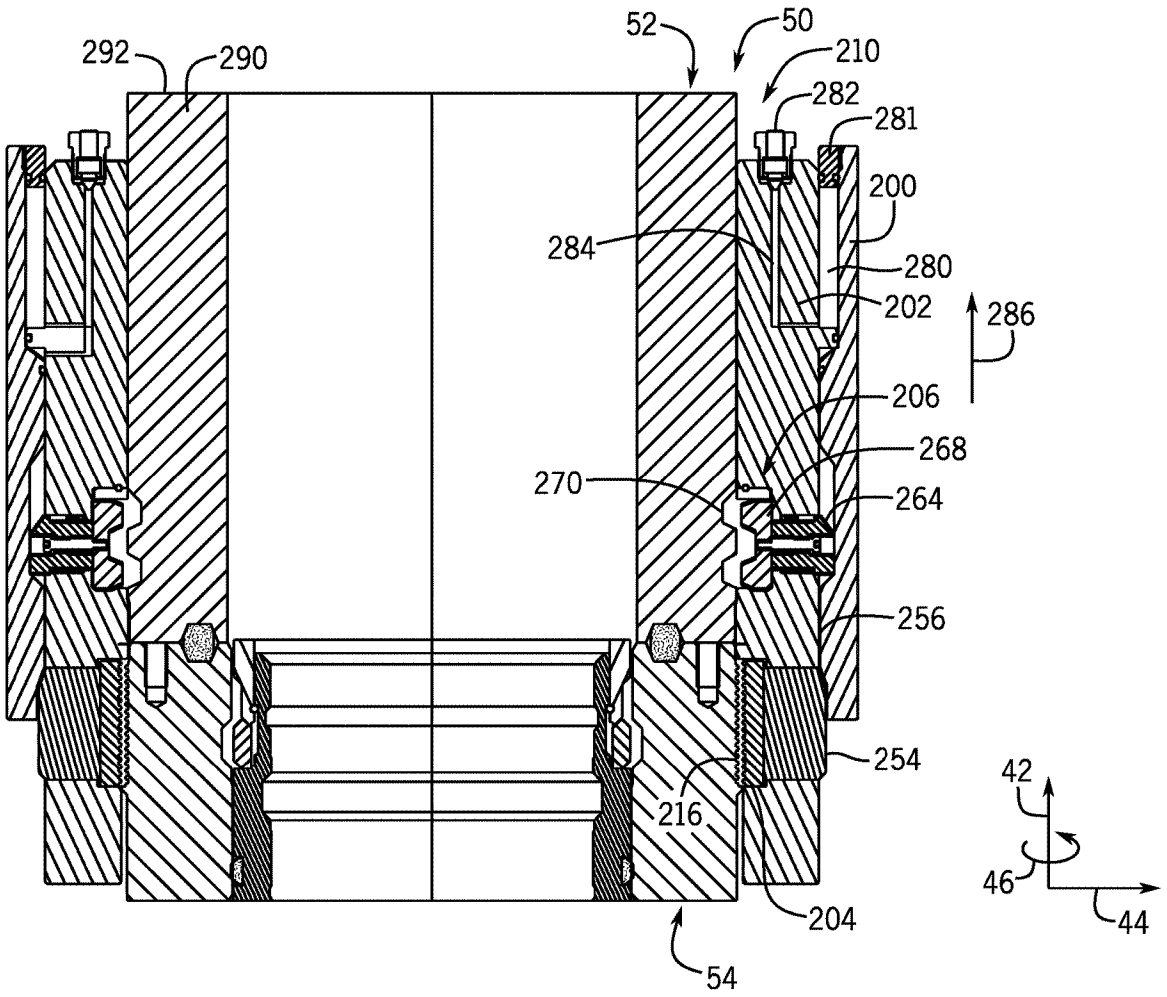
FIG. 11 is a cross-sectional side view of the connector assembly of FIGS. 7-10, wherein the connector assembly is disengaged from the first component and the second component.

FIG. 11 is a cross-sectional side view of the connector assembly 50 of FIGS. 7-10, wherein the connector assembly 50 is disengaged from the first component 52 and the second component 54 and is in the first position 210. The connector assembly 50 may return to the first position 210 by providing fluid to a sealed space 280 (e.g., annular space) defined between the sliding outer sleeve 200 and the body 202 along the radial axis 44. A seal ring 281 (e.g., annular seal ring) may be provided to seal the sealed space 280. The fluid may be provided via one or more ports 282 and corresponding passageways 284 extending through the body 202 of the connector assembly 50, for example. When the fluid is provided to the sealed space 280, the fluid pressure drives the sliding outer sleeve 200 axially, as shown by arrow 286. As the sliding outer sleeve 200 moves axially, the contacting surface 256 of the sliding outer sleeve 200 may move to a position that is axially above the push ring 254, thereby enabling the push ring 254 and the lock ring 204 to move radially outwardly to disengage from the corresponding groove 220 of the second component 54. Similarly, as the sliding outer sleeve 200 moves axially, the contacting surface 266 of the sliding outer sleeve 200 may move to a position that is axially above the push ring 264, thereby enabling the push ring 264 and the dogs 268 to move radially outwardly to disengage from the corresponding groove 270 of the first component 52. Once the lock ring 204 is disengaged from the second component 54, the second component 54 may be moved relative to and/or separated from the first component 52 and the connector assembly 50. Once the dog assemblies 206 are disengaged from the first component 52, the first component 52 may be moved relative to and/or separated from the connector assembly 50.

With reference to FIGS. 7-11, it should be understood that in some embodiments, the connector assembly 50 may include an adapter body 290 (e.g., annular body) that is coupled (e.g., via one or more fasteners, such as bolts) to the first component 52 positioned at a first end 292 (e.g., proximal end) of the adapter body 290. In such cases, the body 202 is positioned circumferentially about the adapter body 290 and coupled to the adapter body 290 (e.g., via a threaded interface, friction fit, fasteners, etc.), and the one or more dog assemblies 206 may engage the adapter body 290 to further support the connector assembly 50 and/or to energize the seal 228 as it joins the first component 52 to the second component 54.

Figure 12:
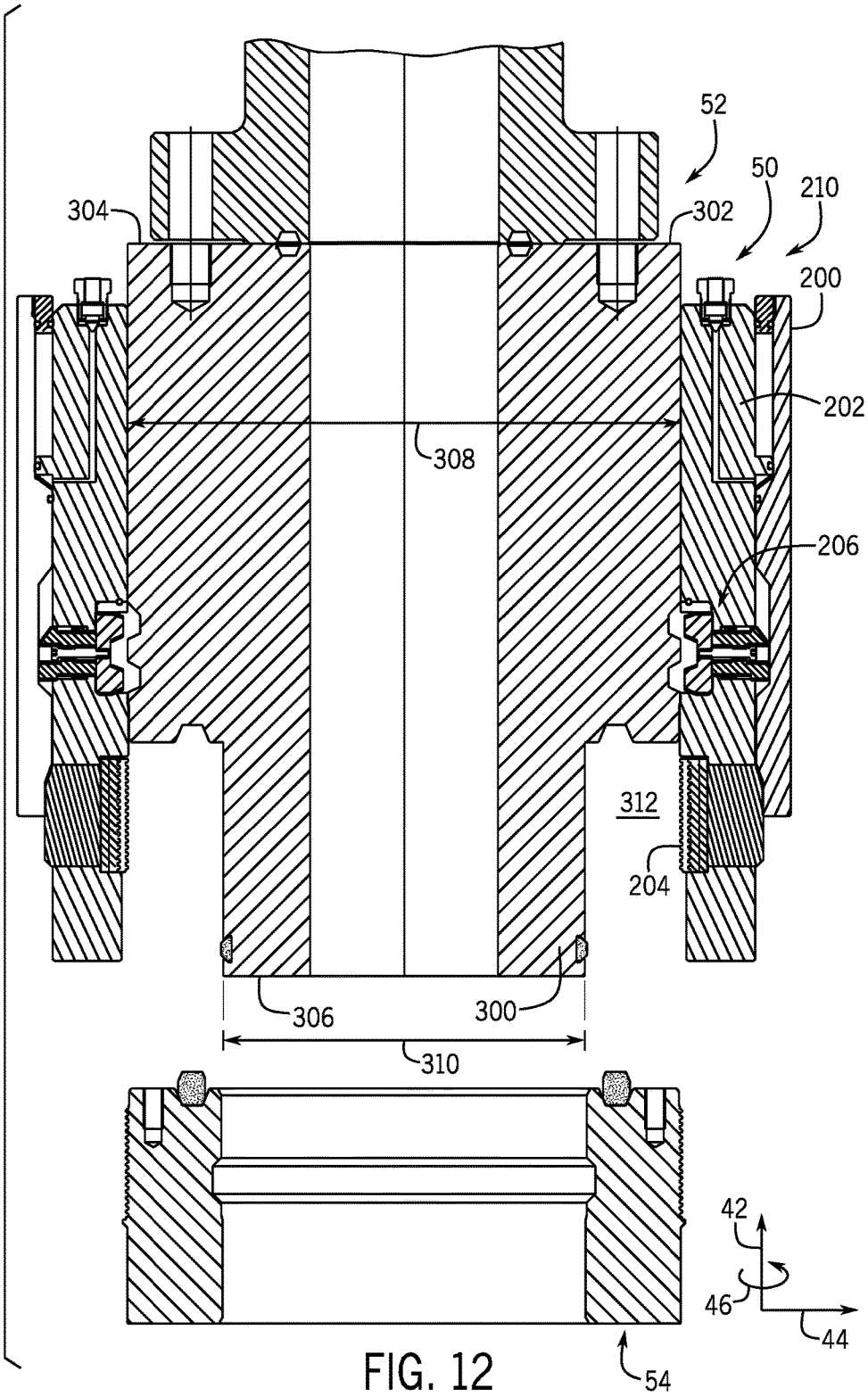
FIG. 12 is a cross-sectional side view of a connector assembly having a stab that may be utilized to join a first component to a second component of the mineral extraction system of FIG. 1.

FIG. 12 is a cross-sectional side view of the connector assembly 50 having a stab 300 (e.g., annular extension) that may be utilized to join the first component 52 to the second component 54. As noted above, the first component 52 and the second component 54 may be any of a variety of structures, including wellhead hub 18, the casing spool 26, the tubing spool 24, the tree 22, the BOP 36, or any of a variety of other components, such as spools, housings, adapters, or pipes that may be utilized with the wellhead 12 or other portions of the mineral extraction system 10.

As shown, the connector assembly 50 includes the sliding outer sleeve 200, the body 202, the lock ring 204, and the one or more dog assemblies 206, as well as other features discussed above with respect to FIGS. 7-11, for example. In the illustrated embodiment, the connector assembly 50 includes an adapter body 302 (e.g., annular body) that extends from a first end 304 (e.g., proximal end) to a second end 306 (e.g., distal end). The first component 52 is coupled to the first end 304 of the adapter body 302 and the stab 300 extends to the second end 306 of the adapter body 302. The adapter body 302 may have a first width 308 proximate the first end 304 and a second width 310 proximate the second end 306 due to the stabs 300. The second component 54 may be received into a space 312 (e.g., annular space) defined between the stab 300 and the lock ring 204 along the radial axis 44.

Figure 13:
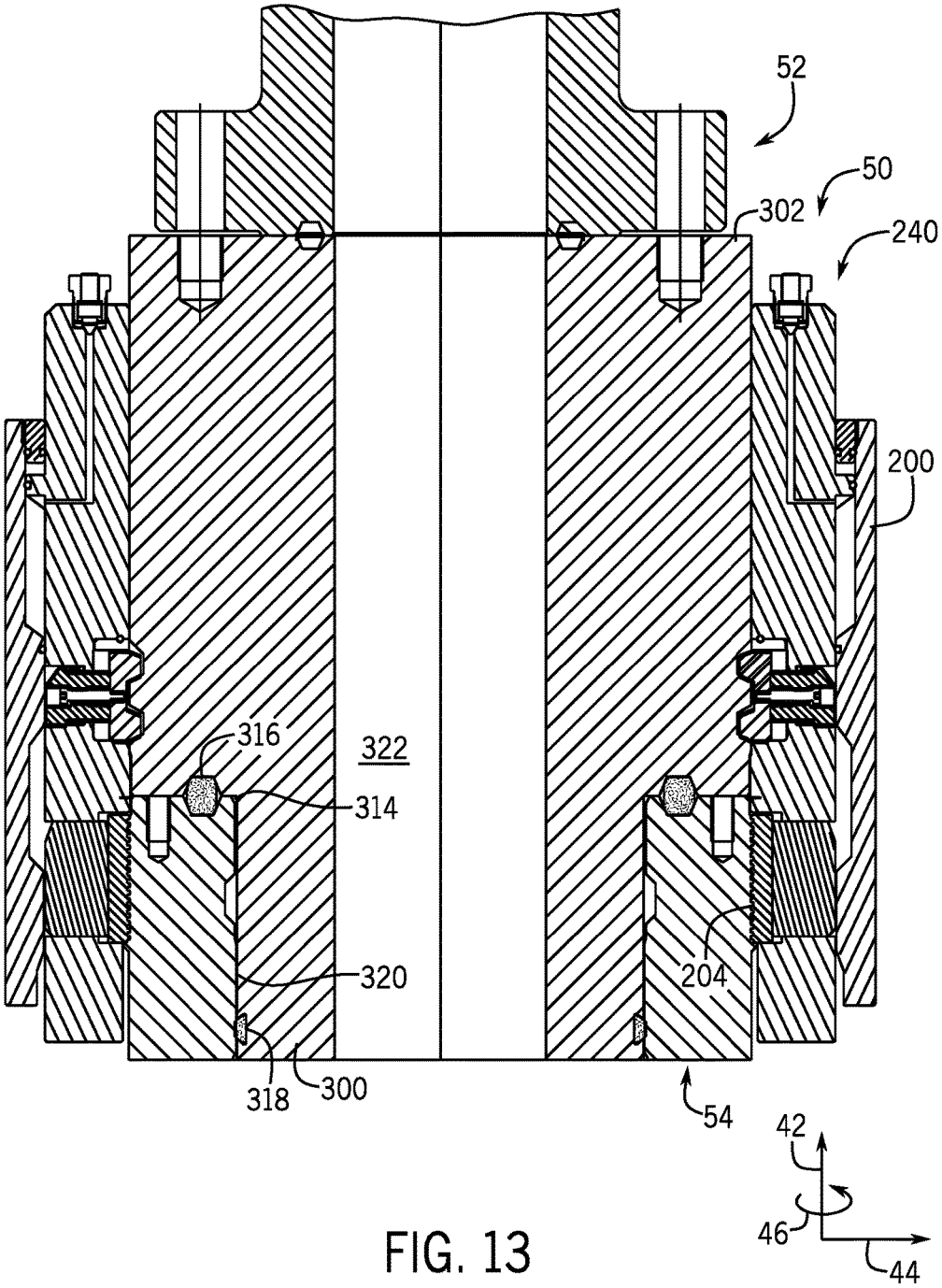
FIG. 13 is a cross-sectional side view of the connector assembly of FIG. 12, wherein the connector assembly engages the first component and the second component.

FIG. 13 is a cross-sectional side view of the connector assembly 50 of FIG. 12, wherein the connector assembly 50 engages the first component 52 and the second component 54. As shown, in the locked position 240, an end 314 of the second component 54 is positioned between the stab 300 and the body 202 of the connector assembly 52 along the radial axis 44. A seal 316 (e.g., o-ring or annular seal) is provided at the end 314 of the second component 54 and a seal 318 (e.g., o-ring or annular seal) is provided about a radially-outer surface 320 (e.g., annular surface) of the stab 300 to block fluid flow out of a bore 322 (e.g., central bore). In some embodiments, the stab 300 may protect the seal 316 from fluid within the bore 322, thereby reducing wear on the seal 316 during certain operations (e.g., where the connector assembly 50 is used to join a frac tree assembly to a spool of the wellhead 12 for fracing operations).

Figure 14:
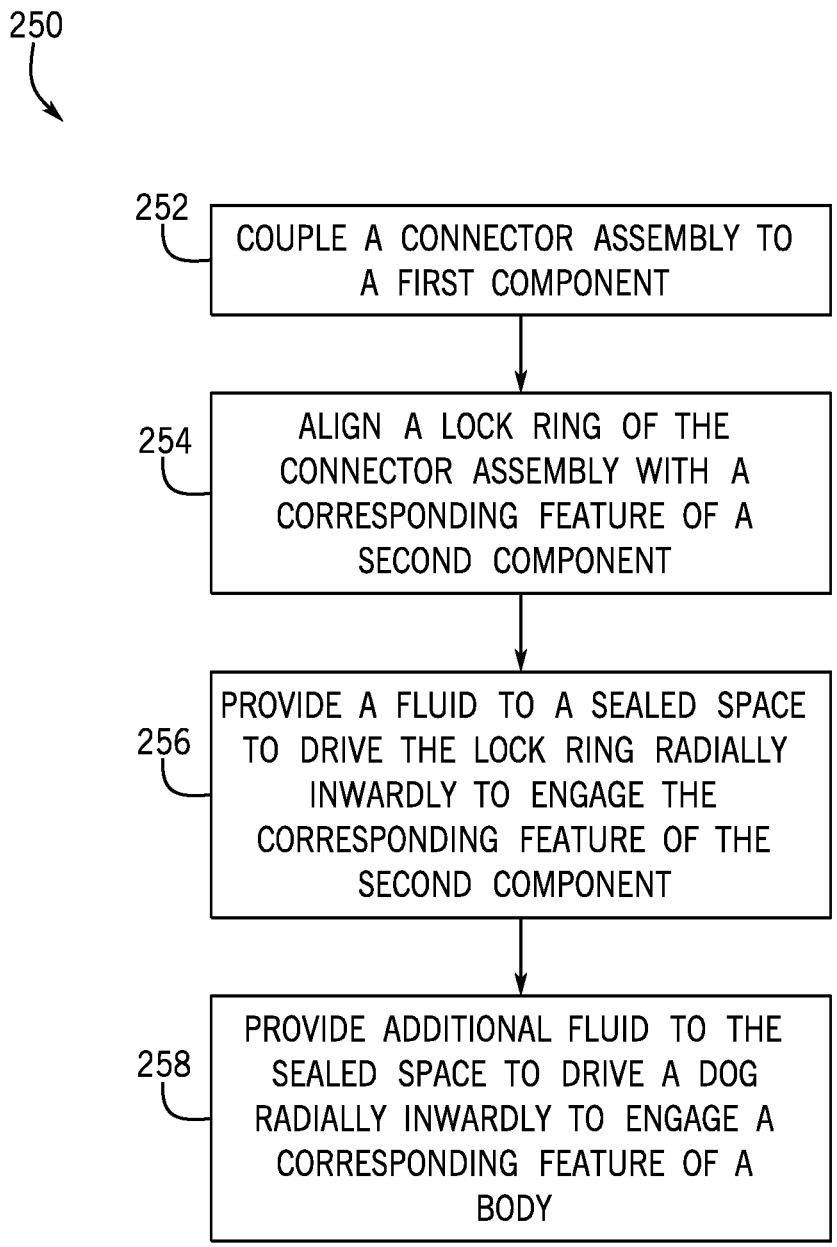
FIG. 14 is a flow diagram of an embodiment of a method for joining two components of a mineral extraction system to one another using the connector assembly of FIGS. 7-13.

FIG. 14 is a flow diagram of an embodiment of a method 350 for joining two components (e.g., the first component 52 and the second component 54) of the mineral extraction system 10 to one another using the connector assembly 50 illustrated in FIGS. 7-13. The method 250 includes various steps represented by blocks. It should be noted that some or all of the steps of the method 250 may be performed as an automated procedure by an automated system and/or some or all of the steps of the method 250 may be performed manually by an operator. Although the flow chart illustrates the steps in a certain sequence, it should be understood that the steps may be performed in any suitable order and certain steps may be carried out simultaneously, where appropriate. Further, certain steps or portions of the method 250 may be omitted and other steps may be added.

The method 250 may begin by coupling the connector assembly 50 to the first component 52, in step 252. In operation, the body 202 of the connector assembly 50 is positioned about the first component 52 and may be coupled to the first component 52 (e.g., via a threaded interface, friction fit, fasteners, etc.). As discussed above, in some embodiments, the connector assembly 50 may include the adapter 290 that is coupled to the first component 52 (e.g., via one or more threaded fasteners).

The lock ring 204 of the connector assembly 50 may then be aligned with the corresponding teeth and grooves 222 of the second component 54, in step 254. For example, the connector assembly 50 may be moved relative to the second component 54 until the lock ring 204 is axially aligned with the corresponding teeth and grooves 222 of the second component 54. The fluid may then be provided to the sealed space 242, which causes the sliding outer sleeve 200 to move axially, which in turn drives the push ring 254 and the lock ring 204 radially-inwardly to engage the corresponding grooves 222 of the second component 54, as shown in step 256. Additional fluid may then be provided to the sealed space 242, which causes the sliding outer sleeve 200 to continue to move axially, which in turn drives the push ring 264 and the dogs 268 radially-inwardly to engage the corresponding grooves 270, which may be formed in the first component 52 or the adapter body 290, depending on the configuration. Thus, the first component 52 and the second component 54 may be joined to one another via the connector assembly 50.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A connector assembly configured to join a first tubular member to a second tubular member of a mineral extraction system, comprising:

a first annular body;

a second annular body;

at least one fastener extending through the first annular body and threadably coupled to the second annular body, wherein a sealed space is defined between the at least one fastener and the first annular body; and a lock ring configured to contact the first annular body and the second annular body; and an outer annular sleeve configured to be disposed about the first and second annular bodies;

wherein a fluid pressure within the sealed space is configured to drive the first annular body and the second annular body toward one another from a first position to a second position, thereby driving the lock ring radially inwardly to engage the second tubular member in a locked position;

wherein the outer annular sleeve is configured to couple together and hold the first and second annular bodies in the second position to hold the lock ring in the locked position after removal of the fluid pressure within the sealed space.

2. The connector assembly of claim 1, wherein the outer annular sleeve comprises a first coupling and a second coupling, the first coupling is configured to couple with the first annular body, and the second coupling is configured to couple with the second annular body.

3. The connector assembly of claim 1, wherein the first coupling comprises a lip configured to abut a shoulder on the first annular body, and the second coupling comprises threads configured to engage mating threads on the second annular body.

4. The connector assembly of claim 1, comprising multiple fasteners positioned circumferentially about the connector assembly, wherein the multiple fasteners extend through the sealed space.

5. The connector assembly of claim 4, comprising an annular seal configured to seal the sealed space, wherein the plurality of fasteners extend through the annular seal, a first seal is disposed between each of the plurality of fasteners and the annular seal, and a second seal is disposed between the annular seal and the first annular body.

6. The connector assembly of claim 1, wherein the lock ring comprises a first tapered surface and the first annular body comprises a first corresponding tapered surface configured to contact the first tapered surface to drive the lock ring radially inwardly.

7. The connector assembly of claim 6, wherein the lock ring comprises a second tapered surface and the second annular body comprises a second corresponding tapered surface configured to contact the second tapered surface to drive the lock ring radially inwardly.

8. The connector assembly of claim 1, comprising an annular seal configured to seal the sealed space, wherein the at least one fastener extends through the annular seal.

9. The connector assembly of claim 8, comprising one or more ports configured to provide the fluid to the sealed space, wherein the one or more ports are supported by the annular seal.

10. The connector assembly of claim 9, wherein the at least one fastener comprises a plurality of fasteners positioned circumferentially about the annular seal, and the one or more ports are spaced circumferentially between the plurality of fasteners.

11. A connector assembly configured to join a first tubular member to a second tubular member of a mineral extraction system, comprising:

an annular body;

an annular outer sleeve positioned circumferentially about the annular body; and a first radial lock supported by the annular body;

a second radial lock supported by the annular body, wherein the first and second radial locks are axially offset from one another;

wherein a sealed space is defined between the annular body and the annular outer sleeve along a radial axis, and a fluid pressure within the sealed space is configured to drive the annular outer sleeve relative to the annular body, thereby driving the first radial lock radially inwardly to engage the first tubular member and also driving the second radial lock radially inwardly to engage the second tubular member.

12. The connector assembly of claim 11, wherein the first radial lock comprises a lock ring and the second radial lock comprises a locking dog.

13. The connector assembly of claim 11, comprising one or more ports and one or more corresponding passageways configured to provide the fluid to the sealed space, wherein the one or more corresponding passageways extend through the annular body.

14. The connector assembly of claim 11, wherein the annular outer sleeve comprises a first tapered surface configured to radially bias the first radial lock and a second tapered surface configured to radially bias the second radial lock in response to axial movement of the annular outer sleeve along the annular body.

15. The connector assembly of claim 14, comprising a first push ring disposed between the annular outer sleeve and the first radial lock and a second push ring disposed between the annular outer sleeve and the second radial lock.

16. A method of joining a first tubular member to a second tubular member of a mineral extraction system using a connector assembly, comprising:

aligning first and second radial locks supported by an annular body of the connector assembly with first and second mating features of the first and second tubular members, respectively; and providing a fluid to a sealed space defined at least in part by the annular body and an annular outer sleeve of the connector assembly, thereby driving axial movement between the annular body and the annular outer sleeve and thereby driving the first and second radial locks radially inwardly to engage the first and second mating features of the first and second tubular members, respectively.

17. The method of claim 16, wherein driving the first and second radial locks comprises moving first and second tapered surfaces on the annular outlet sleeve to radially bias the first and second radial locks, respectively, in response to the axial movement.

18. The method of claim 17, wherein the first radial lock comprises a lock ring and the second radial lock comprises a locking dog.

19. The method of claim 17, comprising a first push ring disposed between the annular outer sleeve and the first radial lock and a second push ring disposed between the annular outer sleeve and the second radial lock.

20. The method of claim 16, wherein the first annular body forms a main body of the first tubular member.

* * * * *